US007215092B2

(12) United States Patent
Grubba et al.

(10) Patent No.: US 7,215,092 B2
(45) Date of Patent: May 8, 2007

(54) RADIO-LINKED, BI-DIRECTIONAL CONTROL SYSTEM FOR MODEL ELECTRIC TRAINS

(75) Inventors: Robert A. Grubba, Ormond Beach, FL (US); Randall L. Luck, Cary, NC (US); Tim Toombs, Apex, NC (US)

(73) Assignee: NC Train Acquisition L.L.C., Kwai Cheong New Territories (HK)

( * ) Notice: Subject to any disclaimer, the term of this patent is extended or adjusted under 35 U.S.C. 154(b) by 0 days.

(21) Appl. No.: 11/218,575

(22) Filed: Sep. 6, 2005

(65) Prior Publication Data

US 2005/0285552 A1 Dec. 29, 2005

Related U.S. Application Data

(63) Continuation of application No. 10/722,592, filed on Nov. 28, 2003, now abandoned.

(60) Provisional application No. 60/511,301, filed on Oct. 16, 2003, provisional application No. 60/511,299, filed on Oct. 16, 2003, provisional application No. 60/511,300, filed on Oct. 16, 2003, provisional application No. 60/429,331, filed on Nov. 27, 2002.

(51) Int. Cl.
*H02P 1/00* (2006.01)

(52) U.S. Cl. ..... 318/268; 318/727; 318/729; 318/806

(58) Field of Classification Search ..... 318/268, 318/727, 729, 798, 806, 581, 580; 340/852–69; 246/187; 388/933; 370/312
See application file for complete search history.

(56) References Cited

U.S. PATENT DOCUMENTS

| | | | | |
|---|---|---|---|---|
| 4,334,221 | A | 6/1982 | Rosenhagen et al. | |
| 5,251,856 | A | 10/1993 | Young et al. | |
| 6,280,278 | B1 | 8/2001 | Wells | |
| 6,281,606 | B1 | 8/2001 | Westlake | |
| 6,457,681 | B1 | 10/2002 | Wolf et al. | |
| 6,485,347 | B1 | 11/2002 | Grubba et al. | |
| 6,494,410 | B2 | 12/2002 | Lenz | |
| 6,539,292 | B1 | 3/2003 | Ames, Jr. | |
| 6,619,594 | B2 | 9/2003 | Wolf et al. | |
| 2003/0064657 | A1 | 4/2003 | Pierson | |
| 2003/0155470 | A1 | 8/2003 | Young et al. | |
| 2003/0156040 | A1* | 8/2003 | Yamaguchi | 340/825.69 |
| 2004/0041726 | A1* | 3/2004 | Tamiya et al. | 342/28 |
| 2005/0157668 | A1* | 7/2005 | Sivan | 370/312 |

* cited by examiner

*Primary Examiner*—Karen Masih
(74) *Attorney, Agent, or Firm*—Vinson & Elkins LLP

(57) ABSTRACT

A wireless system uses a direct UHF radio frequency (RF) signal to control electric trains and train accessories. A controller, such as a handheld unit used by the toy train operator, accepts control commands and transmits encoded control data over a high frequency radio link directly to a receiver, on the toy train or train accessory, which decodes the commands and controls the toy train or toy train accessory functions with either unidirectional or bidirectional communication between the controller and the model train or train accessory. One controller has the ability to control many trains and other model train layout components such as signals and track switches even while other train operators are operating their trains on the same electric train track layout.

23 Claims, 7 Drawing Sheets

RADIO-LINKED, BI-DIRECTIONAL CONTROL SYSTEM FOR MODEL ELECTRIC TRAINS

CROSS-REFERENCE TO RELATED APPLICATIONS

This application is a continuation of prior application Ser. No. 10/722,592, filed Nov. 28, 2003 now abandoned, which is hereby incorporated herein by reference in its entirety.

This application claims the benefit of U.S. Provisional Application No. 60/429,331, filed Nov. 27, 2002 and entitled "RF TDMA System for Controlling Toy Trains" U.S. Provisional Application No. 60/511,301, filed Oct. 16, 2003 and entitled "Direct, Bi-Directional Remote Control of Electric Model Trains" U.S. Provisional Application No. 60/511,299, filed Oct. 16, 2003 and entitled "Drive Motor for Electirc Model Train Smoke Unit and Method of Regulating Voltage to the Smoke Unit Fan Motor and Regulating Smoke Output" and U.S. Provisional Application No. 60/511,300, filed Oct. 16, 2003 and entitled "Method of Speed Control in Model Railroad Locomotives and Means of Communicating Speed Data Back to a Remote Controller". The disclosures of each of the above-identified provisional patent applications, as well as the patents and patent application mentioned below are incorporated herein by reference in their entirety.

FIELD OF THE INVENTION

The present invention relates to model electric trains and model train accessories, and in particular to a system of controlling operations and features of electric model train and model train accessories.

BACKGROUND OF THE INVENTION

In prior art train control systems, control signals are sent unidirectionally via the electrical current on the track. Typically, a model electric train runs on a track consisting of at least two electrically isolated rails, and AC or DC electrical power is supplied to the train from a transformer using the rails as electrical connections. In the absence of a handheld controller, the train's speed and other features are controlled by increasing or decreasing the transformer voltage. A limited number of additional train functions can be controlled by the transformer or control unit. For example, some prior art designs include buttons or switches that sound a horn or bell on the train when activated. As disclosed in U.S. Pat. No. 6,281,606 by Westlake, a throttle can be used for varying the voltage, speed and direction of the model train. Model train layout accessories can also be operated by transformers, but, in many cases, a separate transformer is set up for each individual accessory, and often, several transformers are required to operate a multitude of train layout items.

In more recent years, as technology has become more accessible and more complex, model train manufacturers have moved to control system designs which utilize a remote control to allow more flexibility, more functions and implementation of new features not previously available. If a handheld controller is present, the transformer power is turned on continuously, normally at the highest setting, and each train on the track is controlled by addressing the specific ID number stored in the individual trains, and the handheld controller regulates the voltage from the transformer sent to the model train or model train accessory. One remote controller can be capable of controlling several trains or accessories on the same layout. In addition, multiple handhelds can be used to control the same train as long as each controller inputs the specific D number as assigned to that train.

Some existing systems send digital signals to the train using a two step transmission scheme, wherein the signal is sent from the handheld controller to a base unit or track interface unit. The base unit then places the signal on the track. In some cases, the signal is directly decoupled from the track. In other cases, the signal is radiated from the track and received by an antenna in the train. There is an conventional system common in DC powered layouts. It has a radio or wired handheld controller that sends signals to a digital command control device that superimposes a digital signal over the DC track power. The Digital Command Control (DCC) system, a standard maintained by the National Model Railroad Association, is used to in DC powered train control systems. The DCC system requires that all power to the track be routed through a DCC device that places the signal on the track. A similar conventional system operates on AC track power. This system requires that all power to the track be routed through a specific device that places the signal on the track, adding cost and complexity of installation. This system also requires impedance matching between the various track sections, which further complicates the installation by requiring direct wire connections between the track and the special device at regular intervals.

Another two-step transmission scheme, as seen in U.S. Pat. No. 6,457,681 by Wolf et al., includes a remote control, a track interface unit or an accessory interface unit, a track layout system and receiver in the model train. Commands are entered into the remote control by the user. The track interface unit receives and processes these commands from the remote control into signals that are sent over wires to the track rails. The signals are passed along the track rails and picked up by the model train receiver which then executes the commands related to such functions as speed control, operation of lights, operation of sound and train uncoupling, among others. To operate an accessory, this design has the option of sending signals from the remote control to an accessory interface unit connected to an toy train layout accessory. In addition, the Wolf et al. invention has the ability to connect a computer to the track interface unit to produce sounds and other operational functions. This system requires that all power to the track be routed through an additional, specific device that places the signal on the track, adding cost and complexity of installation.

There are some systems on the market using a 27 MHz or IR signal. These are unacceptable on higher quality trains because the signal is lost in tunnels and complex layouts. In one prior design, a two-step transmission scheme is utilized wherein the handheld controller transmits commands at 27.255 MHz to a base which converts the commands to a 455 kHz transmission using the track as the transmitting antenna. An antenna in each train then receives the commands. The reason for this method is that the 27.255 MHz signal is easily blocked by metal bridges, mountains and other structures common on many layouts, and this problem is avoided if the data goes through the track rails.

Another prior art design, U.S. Pat. No. 4,334,221 by Rosenhagen et al, describes a unidirectional system for controlling multiple model vehicles, in this case the vehicles are cars with multiple remote controllers. The Rosenhagen et al. invention uses the same simple random access, receiver error recognition, and command ignoring collision scheme exactly the same way as the 27.255 MHz system mentioned above. The disadvantage to this random access system is that the base receiver detects a collision if the information received has errors, and the transmission is then ignored. Since the system is unidirectional, there is no feedback to the transmitter, and the user may not realize that the command was ignored and should be tried again.

Some prior inventions use a direct radio link, but only in one direction, and at a lower transmission frequency.

Some prior art, for example U.S. Pat. No. 6,494,410 by Lenz and U.S. Pat. No. 6,539,292 by Ames, Jr., includes a bidirectional communication between the model train and the control device, but the communication is not a direct radio link. These systems still require use of a base control unit or track interface unit and that signals are sent over the track. In both cases, the returned data is limited, often just acknowledging the transmission, and does not present further command options to the toy train operator.

Regarding speed control, as previously described, in early systems, the toy train's speed was increased or decreased by manually operating a throttle or knob on the transformer or power supply which increased or decreased the track voltage. Subsequently, speed control was implemented into the remote control system designs, for example, U.S. Pat. No. 5,251,856 by Young et al. and U.S. Pat. No. 6,619,594 by Wolf et al.

In some conventional systems, the handheld controller will display the desired speed inputted by the train operator, but not the actual train speed. If a second handheld controller is then used to adjust the desired speed of the same train, the first handheld will not register the change. Since it is common for two or more handheld controllers operated by two or more people present during a train's operation, this feature of prior designs causes repeated problems in train operation. As an example, if Handheld One was used to set the desired train speed to 40 scale mph and later, Handheld Two was used to change the speed to 5 scale mph, the display on Handheld One would still register 40 scale mph. Then, if the throttle on Handheld One was used to increase the desired speed, the next increment upward would make the train's actual speed to go immediately to from 5 to 41 scale mph, causing an increase in speed that is too rapid and unrealistic. Rapid increases in train speed such as this can easily cause train collisions or derailment.

Conventional systems rely on the radio receiver and its associated processor to control the motor driver, even when a customer does not have a remote controller.

Early versions of smoke units commonly used in the electric train industry operate by powering the fan motor continuously, thereby making a constant stream of smoke. These designs are considered undesirable and very limiting functionally by manufacturers or train operators who want a train to operate as realistically as possible. Therefore, it is desirable to create more realistic puffs of smoke instead of a steady stream of smoke.

U.S. Pat. No. 6,280,278 by Wells discloses a smoke unit that includes two features that are common to most model train smoke unit designs today: a reservoir to hold the smoke fluid or oil and a heating element to raise the temperature of the fluid or oil to create smoke. Wells implements a pump transmitting smoke fluid or oil to the smoke unit; and in this application, the control of the amount of smoke fluid present in the smoke unit determines smoke output conditions. While this design does aid in a system that produces intermittent smoke, manufacturers prefer designs that include greater control of the smoke output to create a puffing effect.

Other prior art, as seen in U.S. Pat. No. 6,485,347 by Grubba et al., employs a motor driven fan to maintain a flow of air through the smoke unit housing and includes a mechanical means of interrupting or temporarily blocking the airflow from the fan. The blocking means opens and closes at a rate synchronized with the train's speed, and the repetitious interruption in airflow results in puff-like smoke output production. Another puff-producing design, as depicted in U.S. Pat. No. 6,457,681 by Wolf et al., controls the airflow by either applying an electronic brake or reversing the voltage to quickly stop the fan motor and thereby produce abrupt bursts of puffs of smoke.

In U.S. Patent Application Publication No. 2003/0064657 by Pierson, a method is disclosed to vary a model train's smoke output in response to a signal indicating changes in the train's load. A microprocessor controller monitors and receives input of the train's load defined as either the voltage across the model train engine or the speed of the train. The input data is processed through a stored control program, and subsequently, to make adjustments to the changes in load, the controller controls the rotation of the smoke unit fan at a predetermined rate, which, in turn, controls the smoke unit airflow.

U.S. Patent Application Publication No. 2003/0155470 by Young et al. utilizes position indicators along a track to attempt to automatically derive layout geometry and result in automated route selection and automated switch selection.

SUMMARY OF THE INVENTION

This present invention includes a wireless control system for electric model trains and model train accessories. A controller, such as a handheld unit used by the model train operator, accepts control commands from a user and transmits encoded control data over a UHF radio frequency directly to a receiver on the toy train or train accessory, which decodes the control data into the commands to control train or train accessory functions. The communication between the controller and the model train or train accessory can be either unidirectional or bi-directional. One controller has the ability to control many trains and other model train layout components such as signals and track switches even while other train operators are operating their trains on the same electric train track layout. The present invention relates to an apparatus and method of model electric train control and communication, and also relates to improvements in handheld remote control design and operation, microphone sound recording, train track position sensor indicators, and train drive motor assembly. In addition, the improved model train drive motor of the present invention has an optical sensor mounted to it, and a slotted wheel mounted to the motor flywheel which results in improved methods of speed control, smoke output control and chuffing sound timing.

Preferably, every element of the control system of the present invention contains one radio transceiver. Each transceiver contains a micro-controller encoder, a broadcasting transmitter, a radio receiver and micro-controller decoder. Typically, only one half of the transceiver is active at one time. In other words, the transceiver is either receiving, transmitting or off, not both receiving and transmitting at the same time. First, the micro-controller encoder accepts control commands, interprets command inputs and encodes them for transmission. These commands could originate directly from the toy train operator pushing buttons on a handheld control unit or they could come from some other train controller via some other kind of communication link such as RF, serial, USB, parallel, etc. The micro-controller encoder then encodes this information into data sent to a UHF radio transmitter. The UHF radio transmitter takes the encoded commands and broadcasts them to a UHF radio receiver which picks up the transmissions. To transmit, software in each device assembles information into packet of data. This data is sent as a serial data stream to the radio transceiver to be sent as RF. To receive, each device turns on the receiver section and wait for the serial data stream to be provided from the decoder. This is then assembled by software into a packet. Each packet of data contains both address and data information. There are two addresses in each packet, a source address and a destination address. The source address is the address of the sending device. Each address has of a 4-bit device type and a 16-bit address. Addresses are assumed to be unique within the RF range of the device, but are not required to be. The UHF radio receiver located in the toy train or toy train accessory picks up the radio frequency signals from the transmitter and decodes them into baseband encoded signals The micro-controller decoder on the train then decodes the data and controls the train functions. These functions could include, but are not limited to, starting, stopping, accelerating, braking, coupling, and sound, light and smoke controls. A communication network is considered to be bi-directional when information flows to and from any device in the network. In this network, information flows both to and from every device in the network. For example, the handheld controller sends can send a packet to an engine (a "current speed" request, for example), and the engine can send a packet to the handheld ("I'm going 25 mph," for example). Not all communications need to be bi-directional for the network to be bi-directional. For example, the handheld controller may send a packet to an engine to "Go Faster," and no response is required or expected from the engine.

One unique feature and of this invention is the combination of direct radio-linked communication between the controller and the train unit and the bi-directional communication between controller and the train. This system offers direct bi-directional radio link at over 400 MHz between a toy train or toy train accessory, switch or other device and the handheld remote controller. The use of a frequency above 400 MHz results in a short wavelength, capable of passing through metal obstructions commonly used on a model train layout, including stamped steel bridges and tunnels made of metal screen mesh. Wireless transmission by high radio frequency to the train unit is a very direct and avoids extensive wiring. Conventional systems send a radio signal to a track interface base unit that is connected by wires to the track, and commands are sent electrically from the base unit through the track to be picked up by the toy train car. The direct radio link of the present invention allows the customer to take the train to any layout and immediately begin using it. Not only does the bi-directional radio link allow the operator to control functions of the train, but also enables the system to transmit data back to the controller from the train. Sending data back from the train could have many uses. This type of information could include, but would not be limited to, engine identification, location of the train, train speed and direction, odometer value, transmission of the low frequency portion of the audio to an external speaker or subwoofer system, various system and maintenance data and signal strength. In addition, since the signals are bidirectional and direct, other items, multiple controllers and accessories around the toy train track can be controlled and can themselves monitor the status of all other controlled items.

This system can be utilized by a single user or by several toy train operators each operating their own controllers on the same electric train layout or multiple layouts at the same time. To allow for multiple system operators and the subsequent communications from multiple sources to multiple destinations, some form of control scheme must be in place to prevent data collisions. One of several possible collision detection/prevention schemes are implemented. For example, a CSMA/CD method can be used. This scheme is used in data networking systems including the Ethernet. In order to transmit some data, the transmitter must first "listen" to the RF channel and make sure it is not being used. If the RF channel is in use, the transmitter waits a period of time and tries again. If two or more transmitters should happen to try to send data at the same time, a mechanism is available to detects the data collision. In this case, the transmitters back off and wait different random amounts of time before trying again. Another method to solve this problem is to use a TDMA (Time Division, Multiple Access) control system. This scheme is commonly used is some cellular telephone systems and also in satellite/ground station communications. In a TDMA system, time is broken up into slots and each transmitter is given one of these slots. This prevents data collisions because all transmitters have their own time slot. In addition, a method must be used to keep all these time slots synchronized with each other. This is usually done where one of the transmitters periodically transmits a synchronizing beacon signal whether there is data to transmit or not.

Handheld Remote Control

In the exemplary embodiment, the remote control system of the present invention is a direct, bidirectional 916 MHz radio link between a handheld controller and a train or train accessory or other item. One transceiver is housed in a handheld remote control, similar to television and stereo remote controls, featuring a condensed microphone, a liquid crystal display screen (LCD), a rotary throttle, and six groups of push buttons, hereafter described as keys, designated as: Display Screen Keys, Throttle Keys, Paired Keys, Item Keys, Numeric Keys, and Program Keys. Not only does the LCD screen display any of various menus which allow the operator to select commands and conditions of operation, but also it displays returned data, such as train speed, received back from the model train unit. The rotary throttle is a large, round, protruding knob that controls engine speed. Turning the throttle clockwise will increase speed and turning counter clockwise will decrease speed. The microphone is utilized for giving verbal commands and recording train related sounds, train station announcements and the like.

Display Screen Keys

Located just below the display screen are five soft buttons or keys, designated from left to right as S1 through S5, that are used with the display screen.

Their function changes depending on what the user is doing and their application correlates to selections on each of the various display menus. The system of display screen soft keys are designed to control features specific to each train. For example, one train could have a controllable headlight, a smoke unit, a strobe light and a cab light. A track repair train might have a controllable headlight and a gravel tamper. The label for each controllable feature is sent to the handheld when the item is addressed, and is displayed above the soft key that controls that feature.

Throttle Keys

Five keys surround the rotary throttle and are identified by a bell symbol, a whistle symbol, the word LAST, left and right arrows, and a stop sign shaped key with an exclamation mark. The bell located on the train is activated by pressing the bell key and turned off by pressing the key a second time. The train's whistle blows as long as the whistle key is held down on the remote control. The arrow key controls the direction of the train forward or reverse; and each time the direction key is pressed, the train will change direction. When pressed, the LAST key switches immediately to the previously addressed item. The Halt key, shaped as a stop sign with an exclamation mark, stops all addressable products.

Paired Keys

The next group of buttons is a row of 4 keys identified as: Thru/Out; F(Coupler)/R(Coupler); VOL+/−; and Boost/Brake. The Thru/Out key controls train track switches on the layout. After a position sensor has been passed, pressing THRU will throw the upcoming switch to the straight through position without having to address it. If no sensor is available, this will throw the last addressed switch. After a position sensor has been passed, pressing OUT will throw the upcoming switch to the turnout position without having to address it. If no sensor is available, this will throw the last addressed switch. The F/R button controls the uncoupling or release of the model trains couplers to disengage one train car from another train car. When the F on this button is pressed, the front coupler of the engine is opened. When the R is pressed, the rear coupler on the engine is opened. The VOL+/−key raises and lowers the volume. The BOOST key increases engine speed gradually while button is held. The engine will return to the previous speed gradually upon release of the button. This key can also be used to raise the crane boom. The BRAKE key will decrease engine speed gradually while the button is held. The engine will return to previous speed gradually upon release. In addition, this key can also be used to lower the crane boom.

Item Keys

Below the paired keys are the item keys in two rows of three keys each. The top row keys are designated: GRP (Group), ACC (Accessory), and TR (Train Track). The bottom row keys are designated: RTE (Route), SW (Switch), and ENG (Engine). Each of these keys refer to addressable items on the model train layout. When pressed, the key changes the display screen to the related menu, shows the last item in that category addressed, disables the shift functions, and will send commands if numeric keys follow within five seconds of depressing the Item Key. For instance, when ACC (accessory) is pressed, the display screen changes to the ACCESSORY main screen, shows the last accessory addressed, and disables the shift functions. If numeric keys follow within five seconds, the accessory being addressed is changed. All of the functions are capable of addresses of up to at least four digits.

Numeric Keys

Below the Item Keys is a standard format of numerical keys 0–9 with the same configuration as a touch tone phone. On either side of the number 0 is a shift 1 key and a shift 2 key, similar in location to the star and the pound sign on a phone. The Shift 1 Key enables the numeric keys. Similarly, the Shift 2 Key enables the numeric keys in the shift 2 functions. Once an engine or other item is selected, all numeric keys should have the function according to the list below. If the Shift 1 Key or Shift 2 Key is pressed, it will stay latched until either the other Shift Key is pressed, or ENG, TR, RTE, ACC, SW, or AUX is pressed again, returning to normal function. Pressing Shift 1 or Shift 2 twice in a row will also disengage them.

| KEY | FUNCTION | SHIFT 1 | SHIFT 2 |
|---|---|---|---|
| 1 | All aboard message | All aboard 2 | Play record 1 |
| 2 | tower message | Tickets please | record 2 |
| 3 | sound on/RPM increase/labor | water fill/fuel fill | record 3 |
| 4 | departure message | departure message | record 4 |
| 5 | Sound shut down | Lubricate drivers/safety check | record 5 |
| 6 | RPM decrease/drift | coal fill/compressor | record 6 |
| 7 | arrival message | arrival message 2 | record 7 |
| 8 | smoke off | smoke off | record 8 |
| 9 | smoke boost/on | smoke boost/on | record 9 |
| 0 | reset | reset | reset |

Program Keys

At the very bottom of the remote control front is a row of four additional keys: MUTE, REC, PLAY and SET, which control sound, recording, and programming features. The mute key will immediately lower the volume of all items on the layout to zero. Pressing MUTE again will return the volume to the previous setting. From the ENG screen, the RECORD button brings up a record screen. Then a one or two digit number is entered to denote which record sequence is being recorded. This feature can be used by the model train operator to record unique station announcements or other train related sounds. Then, by pressing the PLAY button followed by a one or two digit entry, the recording in that memory location will play. The SET key sets the engine ID# while the program switch is in "PROGRAM" position.

Menu Screens

The main screen is the ENG (Engine) screen and displays the selected engine name and engine number usually four digits long, being addressed, for example: Pennsy 5357. This programmed information is stored in the engine and is sent to the handheld when the engine is addressed. The model train operator will use the Engine Screen to set commands or functions of each particular engine. These commands include turning the headlight on and off, turning the mars light on and off, and controlling the smoke output. In addition, the Engine screen will display the status of the particular engine's conditions regarding lights, smoke output, position, speed, direction, distance, signal strength, switch positions and other variables. For example, when the engine starts moving, the speed, measured in scale MPH, is reported back from the engine and displayed on the screen. Furthermore, the screen will display errors in transmission.

The model train operator has access to additional setup screens and menus such as Sound Setup, Motor Setup, Train Setup, Track Menu, Recording Menu, Playback Menu, Switch Menu and Accessory Menu. Some features of the Sound Setup screen include: automatic playing of various engine sounds, such as refueling and talking; volume control; and train station announcements. Under Motor Setup, the operator can set parameters for minimum and maximum train speed. In the Train Setup Screen, the operator can add or delete specific trains and assign ID numbers and names to each particular engine. While in the Track Menu, the operator has a wide range of features to control. The operator can use the throttle to set minimum and maximum voltage applied to the tracks. When the track menu is selected, if the bell or whistle keys are depressed, the track controller will put a DC offset on the track. Likewise, if the DIR key is held, the track controller will interrupt the track power.

The Switch Screen controls the setting the track switches and turnouts on the layout. The Route Screen controls a group of switches to create a repeatable route. When RTE is pressed, all the switches should be activated, and the route screen should come up. By entering a Switch ID number assigned to a particular switch, the switch can be added or deleted from the route. In the Accessory Menu mode, there is a wide variety of possible functions. Various accessories have smoke, sound, light and operational features that can be controlled by turning power on and off with the remote control. The numeric keys can be assigned to operate specific accessory functions. The Group Command can be used to activate a group of accessories at the same time. Accessories are also assigned D numbers, can be added or deleted from the group, and are classified as momentary or toggle.

Microphone Recordings

A condensed microphone in the handheld remote control offers various recording applications to the model train operator. One application is to record the actual names of train stations used on a specific train layout or to record individual train station announcements. These recordings are temporarily stored in the handheld, and sent to the train as transmission capacity becomes available. Once transmitted, the recordings are stored in the specific train, and can be played back on command or automatically when the train enters the station and/or passes a train track position indicator, described below. The engine type can be set to "passenger," "freight," or other. There are recordings stored in the engine's sound system that are automatically played back based on the operation of the engine. If the engine is designated as "freight," the message played could play something specific to a freight engine, such as "Pull up under the loading ramps," while an engine designated as "passenger" can initiate a passenger train appropriate message such as "Collect your baggage and exit to the rear of the car." A benefit of this design is that other trains on the layout can be controlled while the message is sent.

Using the Record Screen and Playback Screen, the operator is able to record his own station announcements and play them back whenever he chooses. With use of sensors set at various points along the train track layout, a recorded sequence could play as the train car passes the sensor. The Layout Event Recording enables the recording of layout-specific sequences that will be re-played whenever the layout is used, such as the activation of crossing gates, block signals, etc. The recordings will be distance-based so that an operator can slowly run the train past a position indicator, then move a given distance, then trigger an event.

Train Track Position Indicators

Numbered position indicators placed along the track transmit a signal to the train that it has passed that sensor. The indicators could be bar code labels, infrared emitters, or other localized devices. Sensors can be located in the train pickup to read the signal. Other systems use this information to attempt to automatically derive layout geometry. The system of the present invention instead has the user to enter information, for example, which number sensor immediately precedes a switch. Then, while operating a train, once the train crosses that sensor, the "THRU" and "OUT" buttons on the handheld remote control can be used to activate that switch without the user having to specify which switch is being controlled. This saves time, since the user does not have to think about which switch the train is approaching, and press the "SWITCH" key and then its ID. This is important because a person's reaction time is too slow to operate the switch before the train arrives. Having the user enter the data eliminates errors caused when the automatic geometry cannot be derived. It also allows more flexibility, if for example, a user does not want a specific switch used, it can be bypassed by simply not entering an upstream sensor number.

The position indicators are also used to synchronize recorded functions. A user can record an operating session, and then play it back. Since trackside accessories can interface with the model train, if the model train's position is calculated only from the number of motor revolutions, wheel slippage on the track can cause the model train to be out of position. If, for example, a model crane accessory was to load cargo onto the train each time the train passed, and the train's wheels slipped, then the train would become more out of synchronization with the crane with each repeated cycle. By re-synchronizing the recorded functions when the train passes a sensor, the recorded sequence can work correctly.

The position indicators can also provide simplified layout automation for the control of block signals, block power, crossing gates and any other controlled item. A recorded sequence can be started manually, or it can be started automatically when either every or only specified train engines pass the sensor. For example, if a sensor precedes a crossing gate by four feet, a sequence could be recorded so that each time a train passes that sensor heading toward the crossing, the train would proceed four feet, and a command would be issued to activate the crossing gate. In the past, this type function was operated by hard wired pressure sensors or other physical contacts, which required a physical installation. The software based system makes it much easier to change the action without changing the wiring. It also allows a user to specify which trains or types of trains will trigger the action. For example, only passenger trains could be routed into a station, and freight trains could be routed straight through.

Model Train Drive Motor Assembly

The electric model train of the present invention has a drive motor assembly comprising the drive motor, a motor speed sensor, a motor controller circuit board and a radio receiver capable of receiving commands from a handheld remote control. The drive motor has an optical sensor mounted to it, and a slotted wheel mounted to the motor flywheel. As the drive motor spins, each web of the slotted wheel interrupts the light beam of the optical sensor to provide a measure of motor rotation and speed. This information can be used to maintain the speed of a train as it drives around a model train layout. In addition, the sensor can supply information relating to how far a train has traveled, which can be used to accurately record, then play back, a sequence of distance based commands, among other uses. Operating with the smoke unit assembly, the improved drive motor assembly features can also control simulated smoke or steam emission visually similar to that produced by a real locomotives.

Train Speed Control

The information recorded by the motor speed sensor of the drive motor assembly can be used to maintain the speed of a train as it drives around a model train track by increasing or decreasing the power supplied to the motor to compensate for changes in speed or loading caused by hills, irregular track, irregular track voltage or other causes. The actual speed of the train is measured in scale MPH in the train and transmitted to the handheld for display on the screen. The train operator can then use this information to send commands back to the train to increase or decrease speed relative to its current speed. Once the desired speed is reached, the motor controller maintains that speed by increasing or decreasing motor voltage. In response, the motor controller periodically sends a message to the handheld remote control that includes the train's actual speed. The advantage in this approach is that the speed displayed is always accurate, and if the train is controlled by more than one controller, all controllers will display the same reading.

The present invention is much more accurate and reliable than previous systems because in previous systems, the handheld will display the desired speed inputted by the train operator, but not the actual train speed. If a second handheld controller is then used to adjust the desired speed of the same train, the first handheld will not register the change. Since it is common for two or more handheld controllers operated by two or more people to be present during a train's operation, this feature of prior designs causes repeated problems in train operation. As an example, if Handheld One was used to set the desired train speed to 40 scale mph, and later, Handheld Two was used to change the speed to 5 scale mph, the display on Handheld One would still register 40 scale mph. Then, if the throttle on Handheld One was used to increase the desired speed, the next increment upward would make the train go immediately to from 5 to 41 scale mph, causing an increase in speed that is too rapid and unrealistic. Rapid increases in train speed such as this can easily cause train collisions or derailment. A situation such as this can be prevented with use of the present invention because the actual train speed is displayed on all of the remote controllers. Each handheld would display the appropriate speed as reported by the train, and the train would experience no unrealistic speed changes. Even if one of the operators sent a command to increase speed without noting the actual speed on the display, the controller would only tell the train to increase or decrease speed based on the current speed, rather than the desired speed.

Another feature of prior art are various methods to adjust the speed of the model train to compensate for increased loading, hill ascension, etc. The present invention is an improvement on previous processes, since it adjusts the effective voltage supplied to the motor to compensate for various changes in loading, while maintaining a constant speed.

In prior inventions related to use of a handheld controller, the remote control is required to regulate the speed of the train. An additional improvement over prior art in the present design is that even if a customer does not have a remote controller, the speed controller in the model train still monitors the track voltage, and increases or decreases the speed of the train in proportion to the track voltage changes. A table stored in the motor driver circuit is used to determine what percentage of available track voltage is sent to the motor, with the rest being reserved to compensate for increased loading. The values included in the table are uniquely derived to ensure the train has the appropriate amount of reserve power in typical operating conditions. The present system is different from other systems on the market in that existing systems rely on the radio receiver and its associated processor to control the motor driver, even when a customer does not have a remote controller. In the present system, the radio controller can be left out entirely, allowing this system to be used in models that are too small for existing systems to fit.

Smoke Unit Output

Two assemblies work together to operate the smoke unit on the model train or model railroad layout accessory. The basic smoke unit assembly includes a housing, a fan, a fan motor, a reservoir and a resistor. The smoke unit is powered by a drive motor assembly consisting of a drive motor, a motor controller circuit board, an optical sensor, a flywheel and a slotted encoder wheel.

The model train smoke unit assembly operates by electrically heating a resistor inside a reservoir of mineral oil or similar substance until the oil vaporizes and smokes. A motorized fan is used to blow air through the reservoir, forcing the smoke out of the smoke unit and out of the model train or model train layout accessory to simulate smoke or steam emitting from a train smoke stack, building chimney or other application related to model railroad layouts. A drive motor supplies voltage to the fan motor and regulates the fan operation and speed. The smoke unit and drive motor combination can be implemented into certain model train accessories such as a factory or house with a chimney as well as train locomotives, steam or diesel, and train cars such as a caboose with a smoke stack.

As described previously, as the drive motor spins, each web of the slotted wheel interrupts the light beam of the optical sensor, to provide a measure of motor rotation and to synchronize voltage supplied to the smoke fan. Therefore, the voltage is supplied to the fan motor in short durations and is based on the amount of rotation of the drive motor, thereby not only creating the desired effect of puffs of smoke versus a steady stream of smoke but also synchronizing the puffs of smoke with the movement of the locomotive as typical of real steam locomotives.

Not only does this feature create a more realistic smoke emission, but also this design requires only one device to implement, versus two or more devices required in prior designs, which is very beneficial to the model train manufacturer as a space saving feature. Since model trains are so small, use of fewer circuits in a design or a circuit consisting of fewer parts would allow the feature to fit in more types of locomotives or accessories.

Another improvement present in this invention is related to the smoke unit fan motor design. The fan is allowed to coast to a slow stop rather than coming to an abrupt stop. The fan can be weighted appropriate to come to a stop to result in a realistic smoke emission. Not only does this feature create a more realistic smoke emission, but also this design requires only one device to implement, versus two or more devices required in prior designs, which is very beneficial to the model train manufacturer as a space saving feature. Since model trains are so small, use of fewer circuits in a design or a circuit consisting of fewer parts would allow the feature to fit in more types of locomotives or accessories.

Similarly constructed smoke units commonly used in the electric toy train industry operate either by powering the fan motor continuously, thereby making a constant stream of smoke, or by implementing other methods to create puffs of smoke. As indicated already, those designs producing a steady stream of smoke would be considered undesirable and very limiting functionally by a manufacturer or toy train operator who wanted a train to operate as realistically as possible. Other prior art depicts a mechanical means of interrupting or temporarily blocking the airflow from the fan to produce puffs of smoke. One other previous design implements a pump transmitting smoke fluid or oil to the smoke unit. In the present invention, the amount of smoke fluid present in the smoke unit can determine smoke output conditions. Another puff-producing design controls the airflow by either applying an electronic brake or reversing the voltage to quickly stop the fan motor and thereby produce abrupt bursts of puffs of smoke. The present invention differs from any of these previous inventions in two ways. First, the voltage is supplied to the fan motor from the drive motor for short durations of time, sufficient to produce a puff of smoke visually similar to that produced by a real steam locomotive. Second, the fan is allowed to coast to a gradual stop, rather than reversing the voltage or electrically braking the motor which results in sudden stops.

This present invention differs in that it does not rely on a predetermined rate to control the fan motor as an adjustment for load changes, but is determined by the actual rotation of the drive motor under current operating conditions.

Chuffing Sound Timing

The timing of the chuffing sound of a steam engine is based on the number of pulses received from the motor speed sensor. This in an advantage over other systems that synchronize the sounds based on the location of the engines side rod mechanism using a contact switch or similar device. Generally, the chuffing noise is recorded from the steam as it is released from the cylinder of a real locomotive. It is stored in a sound ROM, and when the sound system process receives a signal from the motor driver board, the recording is played back.

DETAILED DESCRIPTION OF THE PREFERRED EMBODIMENT

Figure 1:
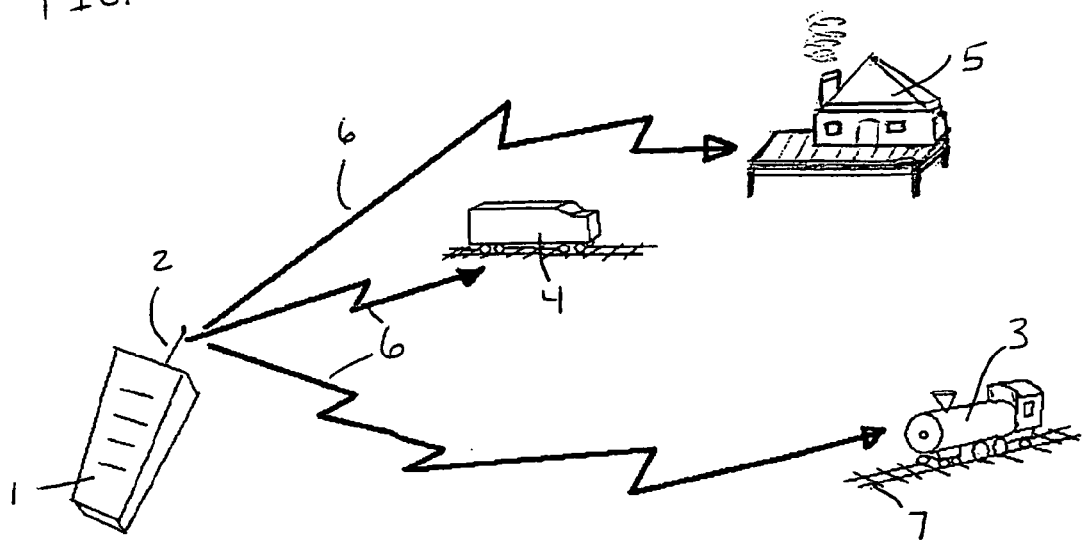
FIG. 1 is a schematic diagram of a unidirectional radio control link according to the present invention.

Referring now to FIG. 1, a schematic diagram of a unidirectional radio linked control system includes a handheld remote control 1 with an antenna 2 and three train receiving units 3,4,5, for example, an electric train locomotive 3, an operating train car 4 or an operating train layout accessory 5. Arrowed lines 6 represent the radio frequency transmitting signaled commands to the three train units 3,4,5. The controller 1 and the train units 3,4,5 are in direct communication, and no intermediary interface unit is required as in prior art two-step communication schemes. In addition, the signals 6 are transmitted directly to the train units 3,4,5 and not through wires to the track 7 to then be pickup by the train unit as in previous designs.

Figure 2:
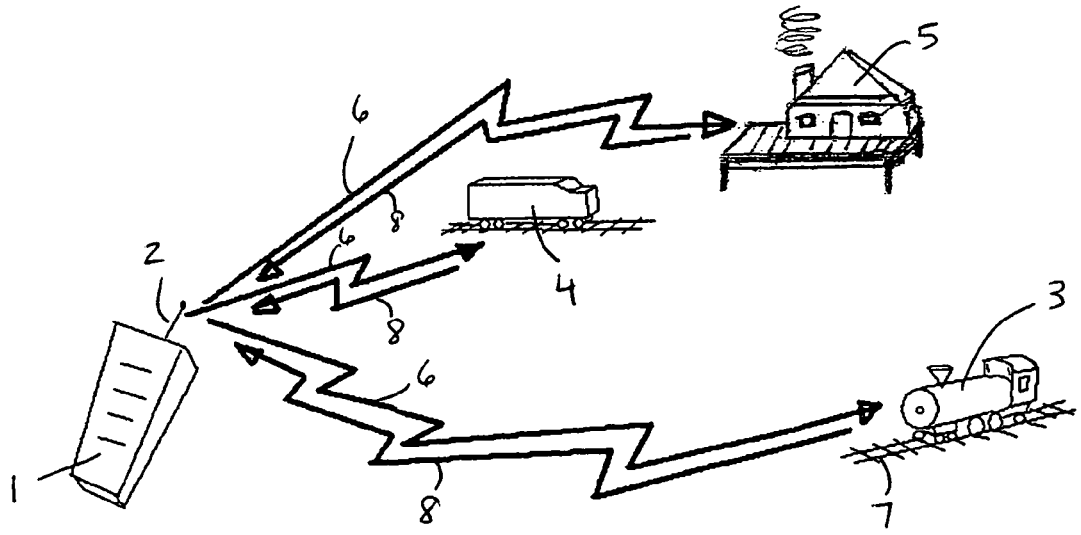
FIG. 2 is a schematic diagram of a bidirectional radio control link according to the present invention.

FIG. 2 similarly shows a schematic drawing of the remote control 1 and train units 3,4,5 of FIG. 1. However, in addition to the arrowed lines 6 depicting radio linked signals traveling from the remote control to the train units, another set of arrowed lines 8 from the train units to the remote control represent transmitted communication from the train locomotive 3, the train car 4 and the train accessory 5 to the remote control handheld unit 1. Therefore, not only can the remote control unit be used by a train operator to send commands to the train unit, but the train units can also respond back to the controller with returned information such as the train unit identification number, the speed of the train, and the location of the train. This system offers direct bidirectional radio link, at over 400 MHz. The use of a frequency above 400 MHz results in a short wavelength, capable of passing through metal obstructions commonly used on a toy train layout such as steel bridges and tunnels made of metal screen mesh.

Figure 3:
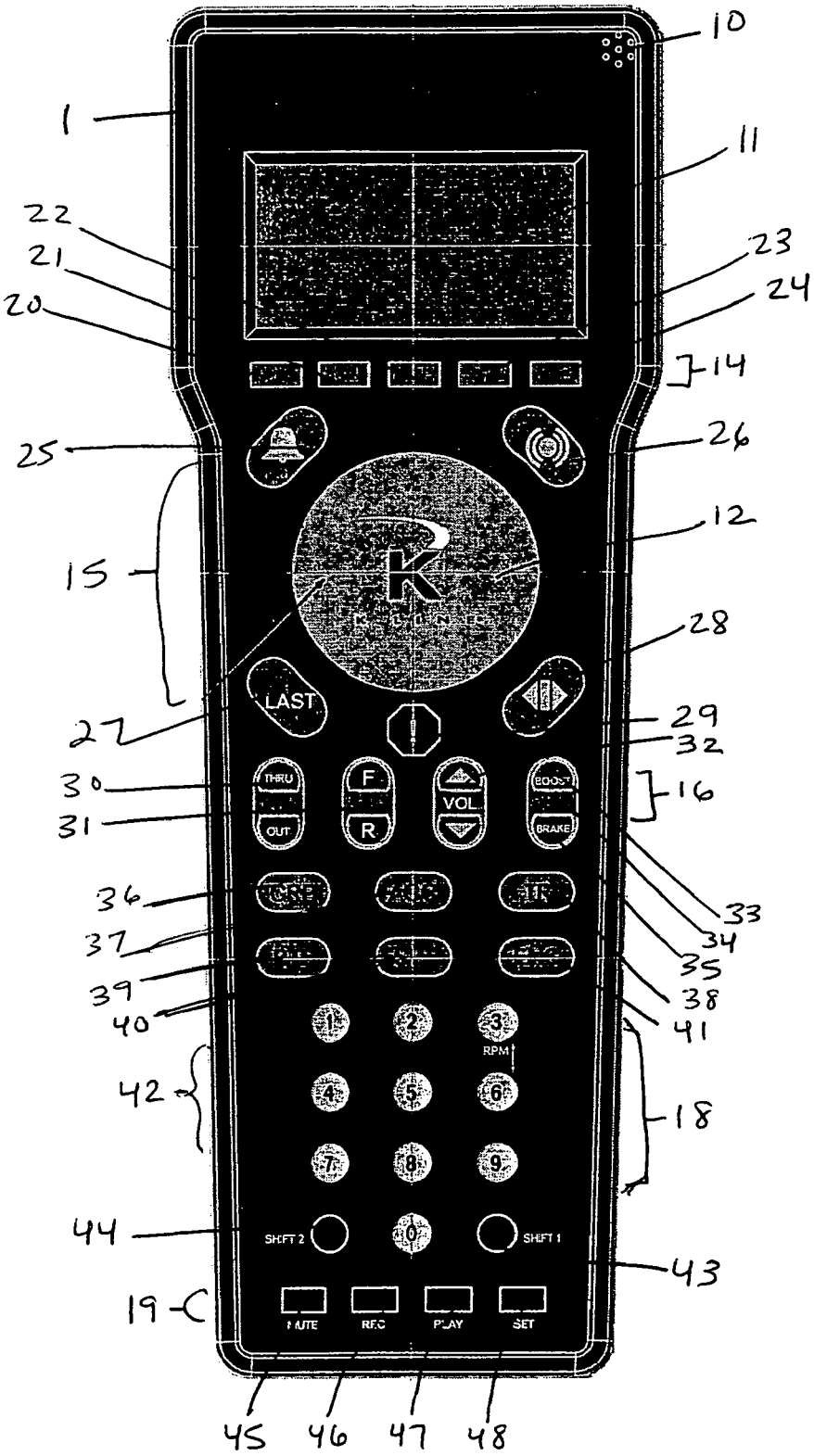
FIG. 3 is a front view of a handheld remote control according to the present invention.

Each remote controller 1, as displayed in FIG. 3, and each train unit contain a transceiver (not shown) comprising a micro-controller encoder, a broadcasting transmitter, a radio receiver and micro-controller decoder. The handheld remote control also has other features that are utilized by the train operator to send commands specific to operational functions of individual train engines, train cars and train accessories. Furthermore, the train operator uses the remote control features to respond to specific information communicated back from the various train units. The handheld controller includes, but is not limited to, the following features within the remote control handheld housing 9: a condensed microphone 10, an LED display screen 11, a rotary throttle 12 and six groups of push keys 13.

Aside from the keys 13, the display screen 11, the rotary throttle 12 and the microphone 10 enable the remote control unit 1 to employing full capabilities of the control system. The display screen 11 displays various menus and operational command options as well as returned data received back from the model train units 3,4,5. The rotary throttle 12 is a large, round, protruding knob that controls engine speed by clockwise or counterclockwise turns. The microphone 10 is utilized for giving verbal commands including assignment of train names and for recording train related sounds, train station announcements and similar messages.

The six groups of keys 13 located on the remote control 1 are designated as: Display Screen Keys 14, Throttle Keys 15, Paired Keys 16, Item Keys 17, Numeric Keys 18, and Program Keys 19. Located just below the display screen 11 are five soft keys, identified, from left to right, as S1 through S5 20-24. The system of Display Screen keys 14 is designed to control features specific to each train, and their application correlates to selections on each of the various display menus.

Five Throttle keys 15 surround the rotary throttle. The bell, located on the train unit, is activated by pressing the Bell key 25 and turned off by pressing the key a second time. The train's whistle blows as long as the Whistle key 26 is held down on the remote control. When pressed, the LAST key 27 switches immediately to the previously addressed item. The Direction key 28, symbolized by two arrows, controls the direction of the train forward or reverse; each time the direction key is pressed, the train will change direction. The Halt key 29, shaped as a stop sign with an exclamation mark, stops all addressable products.

The next group of keys is a row of four Paired keys 16 identified as: Thru/Out 30; F/R31; VOL+/− 32; and Boost/Brake 33. The Thru/Out key 30 controls train track switches on the layout. The F(Coupler)/R(Coupler) 31 button controls the uncoupling or release of the model trains couplers to disengage one train car from another train car. The VOL+/− key 32 raises and lowers the volume. The BOOST function 33 of the Boost/Brake key 34 increases engine speed gradually while button is held. The BRAKE function 35 will decrease engine speed gradually while the button is held.

Below the Paired keys 16 are two rows of three Item keys 17. The top row keys are designated: GRP (Group) 36, ACC (Accessory) 37 and TR (Train Track) 38. The bottom row keys are designated: RTE (Route) 39, SW (Switch) 40 and ENG (Engine) 41. Each of these item keys refers to addressable items on the train layout. When pressed, the key changes the display screen 11 to the related menu, shows the last item in that category addressed, disables the shift functions and sends commands.

Below the Item Keys 17 is a standard format of Numeric Keys 42 numbered as 0–9 as a touch-tone phone configuration and which can be assigned various functions. On either side of the number 0 is a Shift 1 key 43 and a Shift 2 key 44, similar in location to the star and the pound sign on a phone. The Shift 1 Key enables the numeric keys. Similarly, the Shift 2 Key enables the numeric keys in the shift 2 functions. Once the train engine 3, car 4 or accessory 5 is selected, all numeric keys activate a corresponding function At the very bottom of the remote control 1 front is a row of four additional Program Keys 19: MUTE 45, REC 46, PLAY 47 and SET 48, that control various sound, recording, and programming features. The Mute key will immediately lower the volume of all items on the layout to zero and will return to the previous setting when pressed a second time. From the ENG (Engine) screen menu, the RECORD button brings up a record screen. This feature can be used by the model train operator to record unique station announcements or other train related sounds. Then, by pressing the PLAY button followed by a one or two digit entry, the recording in that memory location will play. The SET key sets the engine ID number while the program switch is in "PROGRAM" position.

Figure 4:
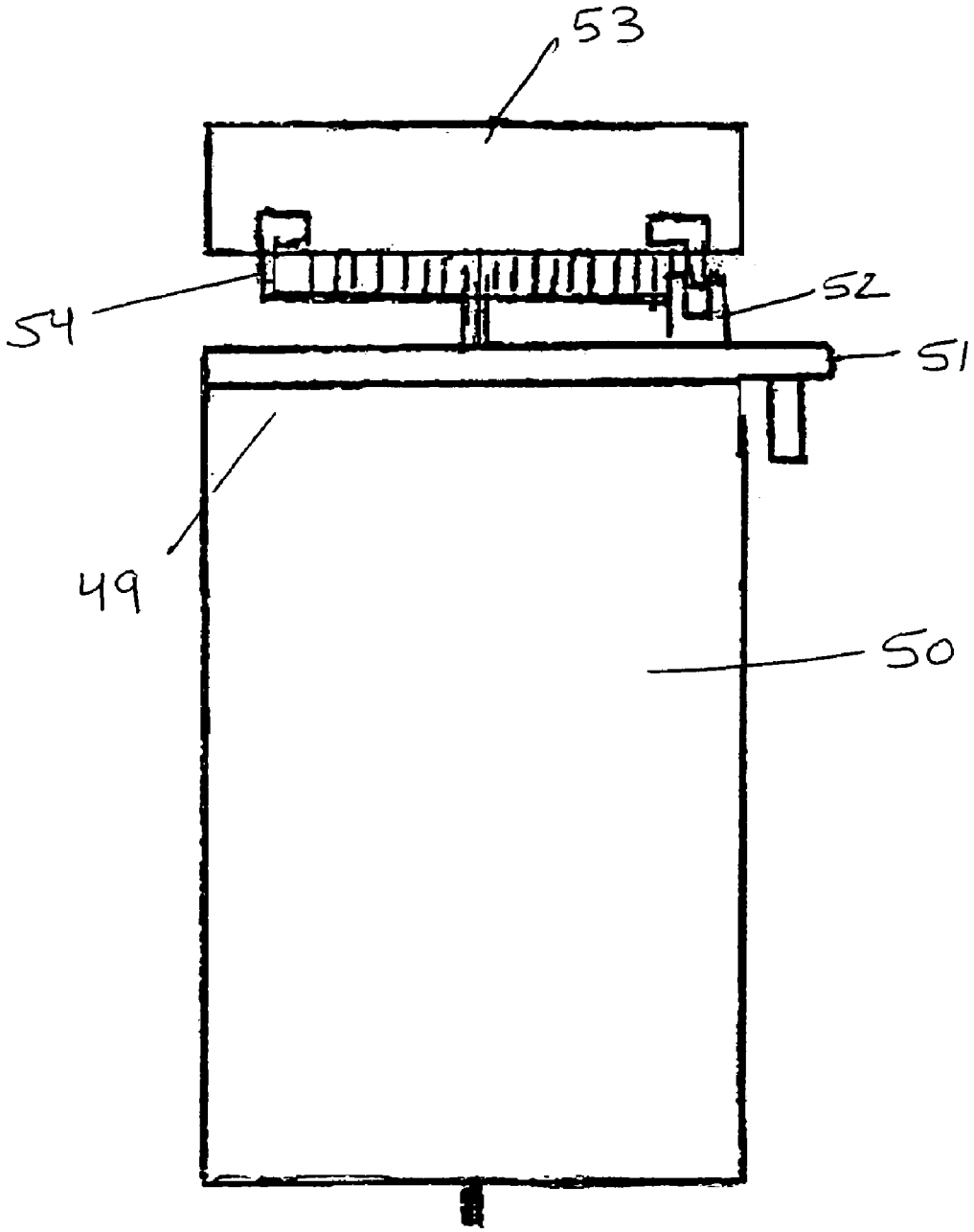
FIG. 4 is a side view of the motor assembly according to the present invention.
Figure 5:
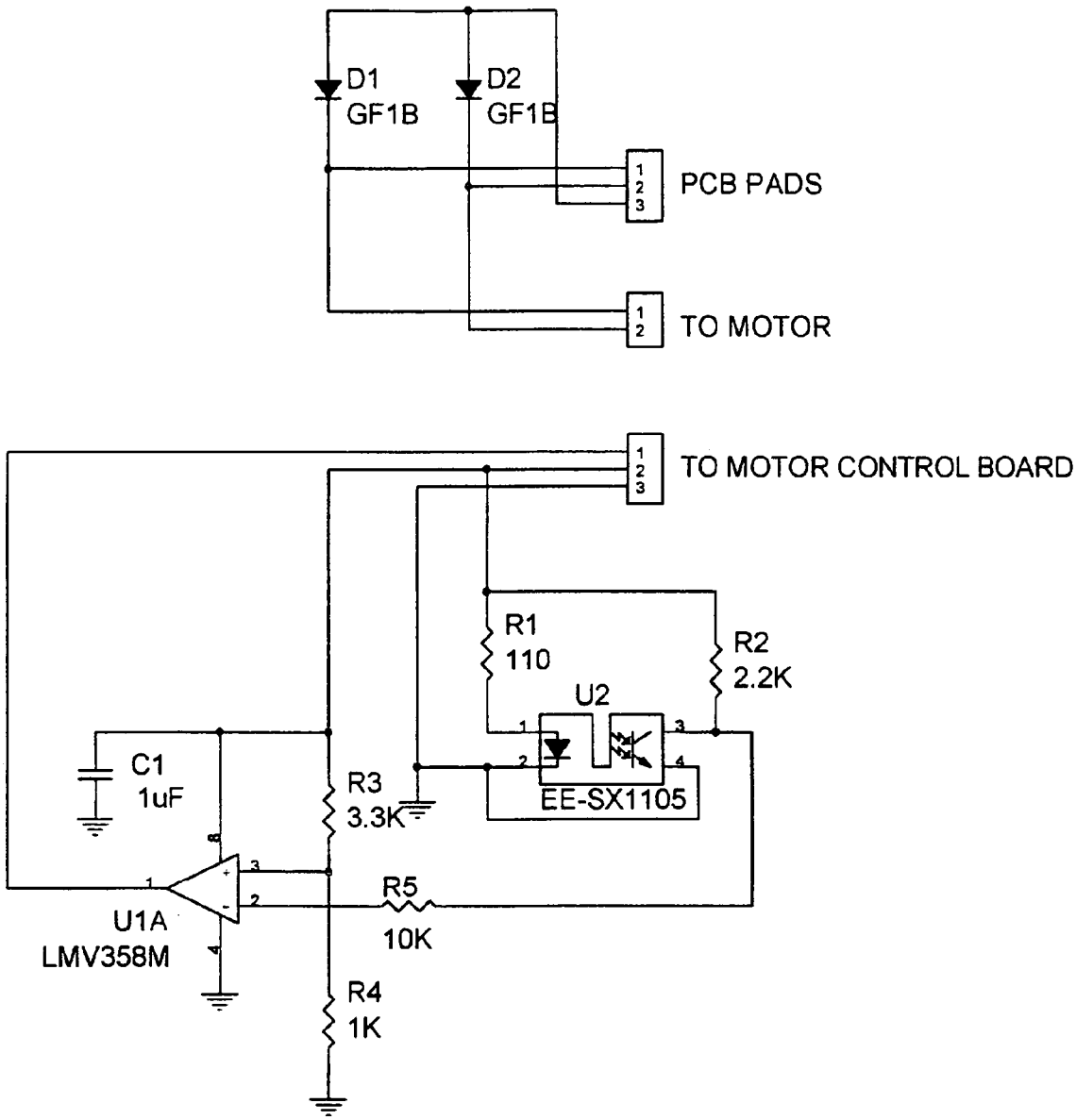
FIG. 5 is a schematic diagram of the speed sensor circuit board according to the present invention
Figure 6:
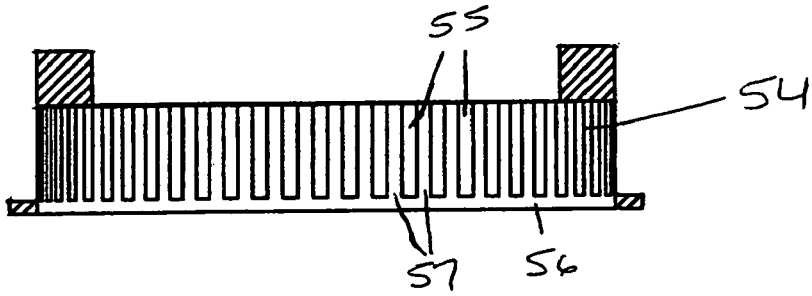
FIG. 6 is an enlarged side view of the said slotted encoder wheel of FIG. 4.
Figure 7:
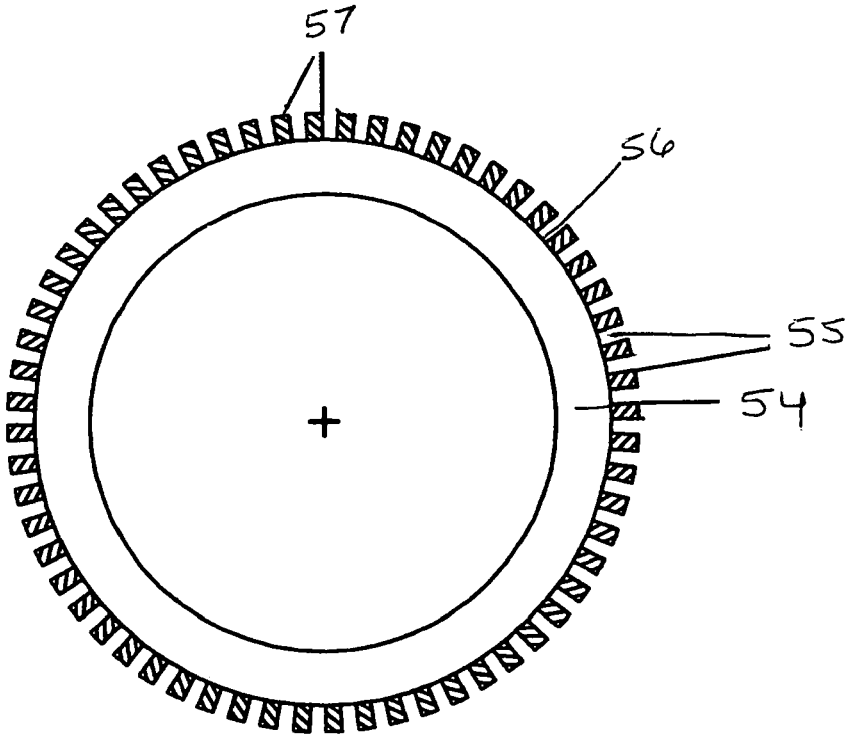
FIG. 7 is an enlarged top plan view of the said slotted encoder wheel of FIG. 4.

The drive motor assembly 49 of FIG. 4 includes the drive motor 50; the speed sensor circuit board 51, also seen as a schematic drawing in FIG. 5; the optical sensor 52, the flywheel 53; and the slotted encoder wheel 54. The encoder 54, as seen in FIGS. 6 and 7, is a round wheel with sixty slots 55 evenly spaced along the rim 56 of the encoder wheel. As the slotted encoder turns mounted to the motor flywheel 53, the encoder wheel rim protrusions 57 interrupt a beam of light on an optical transmitter and receiver pair (U2) 52 of the speed sensor board 51. As the motor 50 spins, electrical pulses are generated at a rate proportional to the speed of the motor. The faster the motor turns, the faster the pulse rate. These pulses are sent to the motor speed controller and power driver circuit on the motor controller circuit board 58 of FIG. 8.

Figure 8:
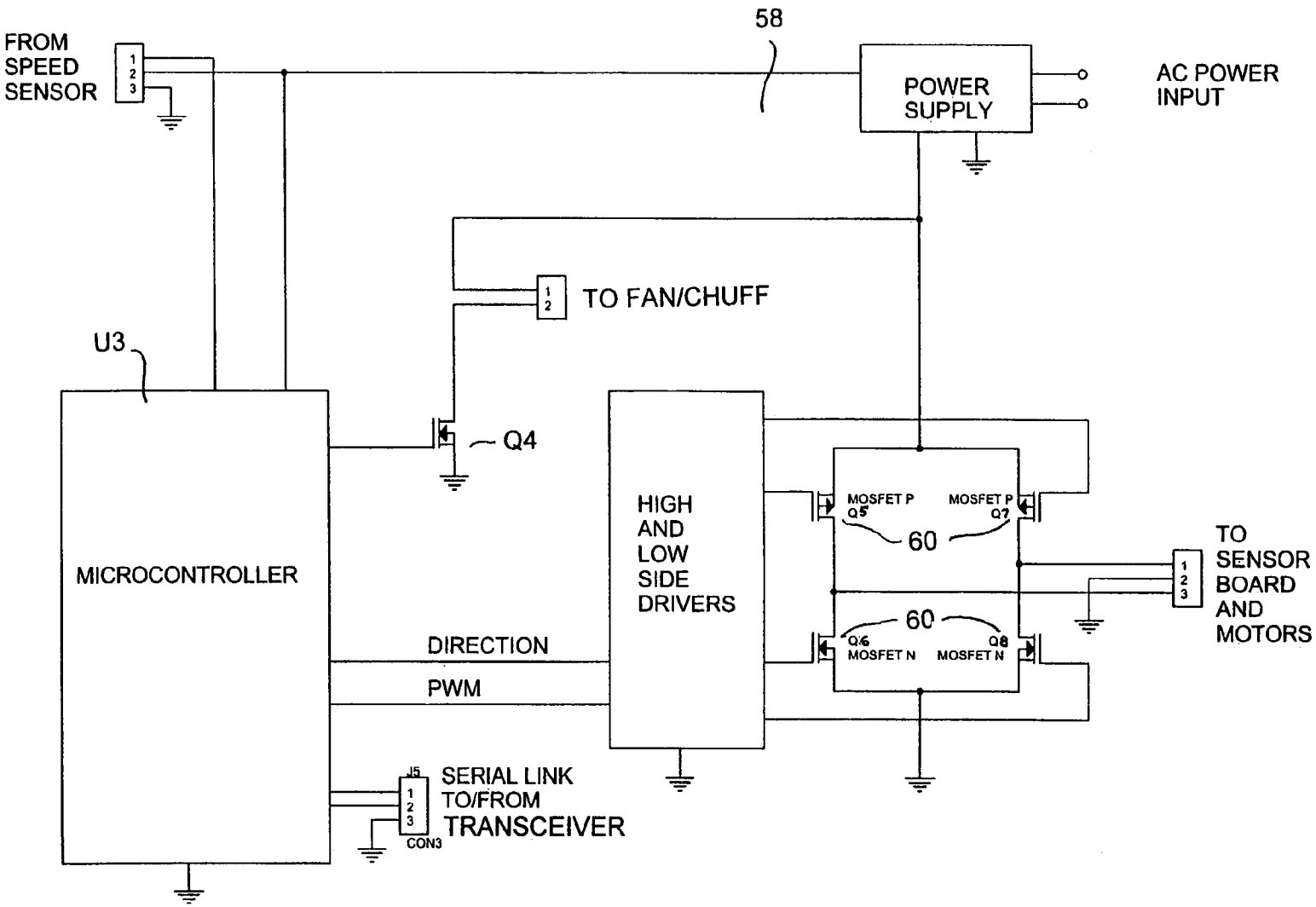
FIG. 8 is a schematic diagram of the motor controller circuit board according to the present invention.

Furthermore, the microprocessor (U3) of FIG. 8 monitors the frequency of these pulses. It then algorithmically compares this rate to the desired rate for the particular speed setting, and increases or decreases the voltage provided to the drive motor 50 as needed, thereby causing the motor speed to match the set speed. In the present invention, the motor voltage is set with pulse width modulation techniques and four transistor switches (Q5, Q6, Q7, Q8) 60 arranged in an H bridge configuration around the motor. In addition to providing speed control, this H bridge arrangement is also used to determine the polarity of the motor voltage and thus the rotational direction.

Figure 9:
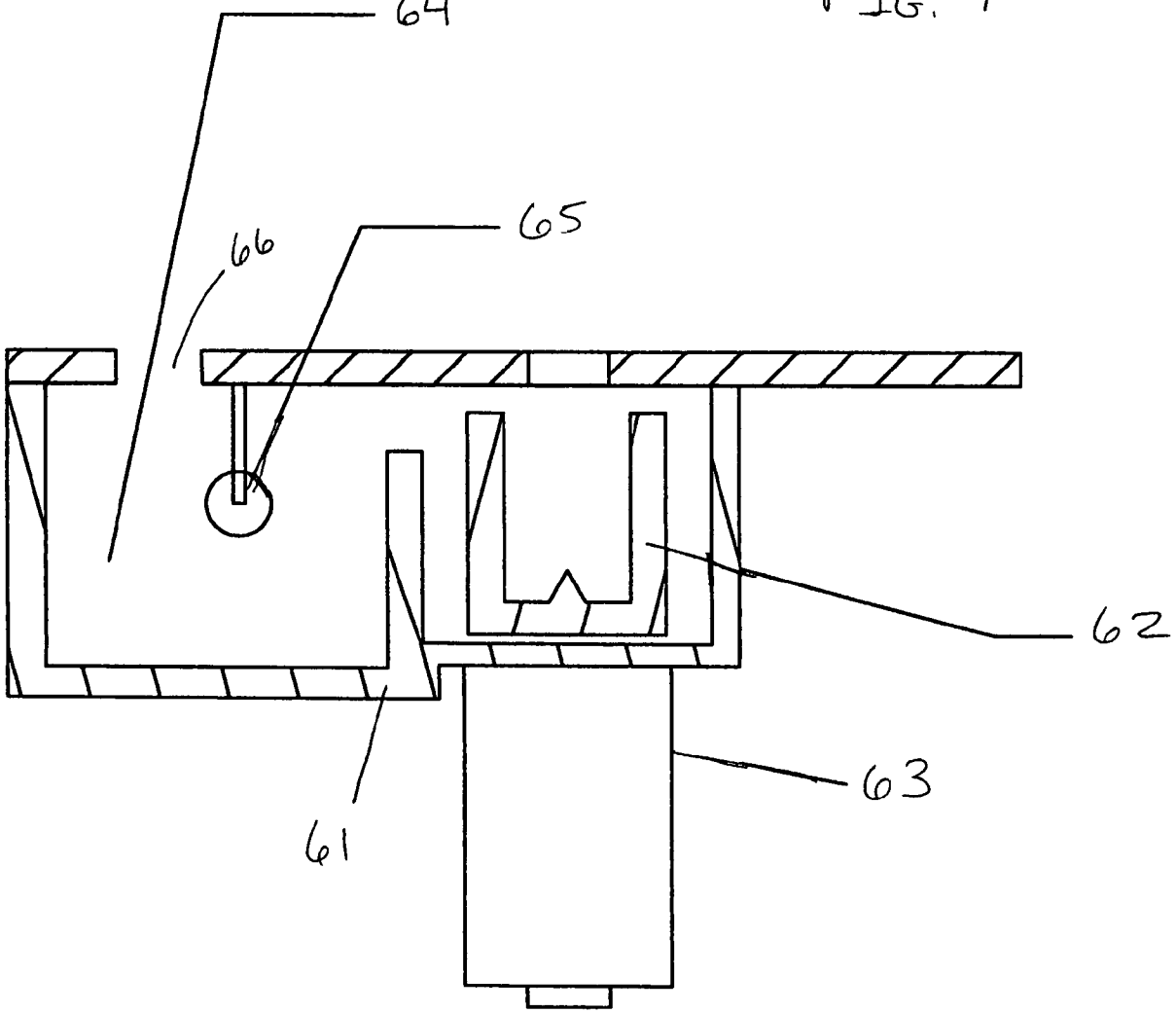
FIG. 9 is a side cross-sectional view of the smoke unit assembly according to the present invention.

The drive motor assembly of FIG. 4 also operates in conjunction with the smoke unit assembly 61 of FIG. 9 to produce smoke output with the resulting effect of puffs of smoke synchronized with the movement of the locomotive as typical of real steam locomotives. The basic smoke unit assembly includes in a housing, a fan 62, a fan motor 63, a reservoir 64 and a resistor or other heating element 65. The train smoke unit assembly 61 operates by electrically heating the element inside a reservoir of mineral oil or similar substance until the oil vaporizes and smokes. The motorized fan 62 is used to blow air through the reservoir 64, forcing the smoke out of the smoke unit opening 66. The voltage to the fan motor is supplied by the drive motor. As already described, as the drive motor spins, each web of the slotted wheel interrupts the light beam of the optical sensor to provide a measure of motor rotation. Therefore, the voltage is supplied to the fan motor in short durations and is based on the amount of rotation of the drive motor. No other electrical or mechanical mechanisms are employed that either block the airflow or stop the fan.

The smoke is synchronized with the drive motor by software. IN the motor driver circuit, the third pin of the connector J2 is connected directly to the fan motor. The transistor labeled Q4 actually turns on the fan at the appropriate time, and also causes the sound system to make a "chuff" sound. The software takes into account the gear ratio, the number of slots in the slotted encoder wheel, and the desired number of chuffs per revolution of the locomotive drive wheels. The processor then counts the encoder pulses and turns on the fan after the appropriate number of pulses. For example, the encoder wheel has 60 slots. In a locomotive with a 10:1 gear ratio, if one chuff per revolution of the drive wheels is desired, the fan would be turned on after every 600 pulses.

It will be apparent to those skilled in the art and it is contemplated that variations and/or changes in the embodiments illustrated and described herein may be made without departure from the present invention.

The invention claimed is:

1. A control system for model trains, comprising:

a controller for accepting control commands from a user, the controller including a controller transmitter that transmits control data at a UHF radio frequency of at least 400 MHz; and a train including a train receiver for receiving the control data from the controller.

2. The control system of claim 1, wherein the train further includes a train transmitter for transmitting train data, and wherein the controller further includes a controller receiver for receiving the train data from the train transmitter in any location of the train transmitter.

3. The control system of claim 2, wherein the train data includes data relating to at least one of signal strength of the control data, speed of the model train, engine identification, and model train location.

4. A model train drive motor assembly, comprising:

a drive motor including a motor flywheel and a slotted wheel mounted on and rotating with the motor flywheel, said slotted wheel including a plurality of protrusions defining the slots;

an optical motor speed sensor with an emitter for emitting a light beam and a receiver for receiving the light beam, wherein the protrusions of the slotted wheel are arranged to interrupt the light beam as the slotted wheel rotates to produce electrical pulses which indicate motor rotation speed;

a microprocessor for receiving the electrical pulses and determining the actual speed of the train; and a radio receiver for receiving commands from a remote controller.

5. A control system for model trains, comprising:

a controller for accepting control commands from a user, the controller including a controller transmitter that transmits control data at a UHF radio frequency of at least 400 MHz; and a train including a train receiver for receiving the control data from the controller and a train transmitter for transmitting train data, wherein the controller further includes a controller receiver for receiving the train data from the second transmitter, and wherein the train further includes a model train drive motor assembly, the motor assembly including a drive motor including a motor flywheel and a slotted wheel mounted on and rotating with the motor flywheel, said slotted wheel including a plurality of protrusions defining the slots;

an optical motor speed sensor with an emitter for emitting a light beam and a receiver for receiving the light beam, wherein the protrusions of the slotted wheel are arranged to interrupt the light beam as the slotted wheel rotates to produce electrical pulses which indicate motor rotation speed; and a microprocessor for receiving the electrical pulses and determining the actual speed of the train.

6. The control system of claim 5, wherein the control data includes a speed setting, wherein the train receiver transmits the speed setting to the microprocessor, and wherein the microprocessor monitors the actual speed and adjusts voltage provided to the drive motor such that the actual speed matches the speed setting.

7. The control system of claim 6, wherein the control system includes a plurality of trains, and the controller includes a plurality of soft keys for controlling features specific to a particular train.

8. The control system of claim 7, wherein the controller further includes a display screen to display functions associated with the soft keys arranged below the display screen.

9. The control system of claim 6, wherein the controller includes a microphone and means for temporarily storing a voice recording, said controller providing the voice recording to the train as the control data.

10. The control system of claim 6, wherein the control system further comprises a track layout and position indicators arranged along the track layout for transmitting a signal to the train as the train passes the position indicators.

11. The control system of claim 10, wherein the train includes a recording that can be activated by the signal from one of the position indicators.

12. The control system of claim 10, wherein the indicators are at least one of bar code labels and infrared emitters.

13. The control system of claim 10, wherein the track layout includes track accessories associated with the position indicators that are activated as the train passes the position indicators.

14. The control system of claim 6, wherein the second transmitter on the train transmits the actual speed of the train to the controller.

15. The control system of claim 6, wherein the train includes means for providing a chuffing sound operated synchronously with the electric pulses from the drive motor.

16. The control system of claim 11, wherein the train includes means for associating the train with an engine type, and the recording played by the train depends on the engine type.

17. A model train drive motor assembly for driving a model train at a speed setting, comprising:

a drive motor including a motor flywheel and a slotted wheel mounted on and rotating with the motor flywheel, said slotted wheel including a plurality of protrusions defining the slots;

an optical motor speed sensor with an emitter for emitting a light beam and a receiver for receiving the light beam, wherein the protrusions of die slotted wheel are arranged to interrupt the light beam as the slotted wheel rotates to produce electrical pulses which indicate motor rotation speed; and a microprocessor including a motor drive circuit for receiving the electrical pulses and determining the actual speed of the train, wherein the microprocessor monitors the actual speed and adjusts voltage provided to the drive motor such that the actual speed matches the speed setting.

18. The model train drive motor assembly of claim 17, wherein the microprocessor stores a table to determine an amount of drive motor voltage and an amount of reserve voltage.

19. The control system of claim 10, wherein each of the position indicators can be associated with an ID assigned by the user.

20. The control system of claim 19, wherein the track layout includes track switches, wherein one of the position indicators immediately precedes each of the track switches to initiate the respective track switch, and wherein me ID of the position indicator corresponds to the respective track switch.

21. A model train drive motor assembly, comprising:

a drive motor including a motor flywheel and a wheel mounted on and rotating with the motor flywheel, said wheel including a plurality of alternating indicators;

an optical motor speed sensor with an optical detector that can detect the alternating indicators as the wheel rotates to produce electrical pulses which indicate motor rotation speed; and a microprocessor including a motor drive circuit for receiving the electrical pulses and determining the actual speed of the train.

22. The model train drive motor assembly of claim 21, wherein the microprocessor monitors the actual speed and adjusts voltage provided to the drive motor such that the actual speed matches the speed setting.

23. The model drive motor assembly of claim 22, wherein the microprocessor stores a table to determine an amount of drive motor voltage and an amount of reserve voltage.

* * * * *

UNITED STATES PATENT AND TRADEMARK OFFICE

CERTIFICATE OF CORRECTION

PATENT NO. : 7,215,092 B2
APPLICATION NO. : 11/218575
DATED : May 8, 2007
INVENTOR(S) : Grubba et al.

It is certified that error appears in the above-identified patent and that said Letters Patent is hereby corrected as shown below:

Column 18, line 15, for the claim reference numeral 17, delete the word “die” and insert the word --the--.

Column 18, line 35, for the claim reference numeral 20, delete the word “me” and insert the word --the--.

Signed and Sealed this

Thirty-first Day of July, 2007

JON W. DUDAS
*Director of the United States Patent and Trademark Office*